US007086972B2

(12) United States Patent
Bainbridge et al.

(10) Patent No.: US 7,086,972 B2
(45) Date of Patent: Aug. 8, 2006

(54) HEIGHT ADJUSTABLE GOLF TEE SUPPORT APPARATUS

(76) Inventors: Robert G. Bainbridge, 143 Lindsey La., Port Townsend, WA (US) 98368; Debra J. Bainbridge, 143 Lindsey La., Port Townsend, WA (US) 98368

( * ) Notice: Subject to any disclaimer, the term of this patent is extended or adjusted under 35 U.S.C. 154(b) by 0 days.

(21) Appl. No.: 10/811,267

(22) Filed: Mar. 26, 2004

(65) Prior Publication Data

US 2005/0215356 A1 Sep. 29, 2005

(51) Int. Cl.
*A63B 57/00* (2006.01)

(52) U.S. Cl. ..... 473/386; 473/396

(58) Field of Classification Search ..... 473/386–403; 52/707–709

See application file for complete search history.

(56) References Cited

U.S. PATENT DOCUMENTS 3,516,664 A * 6/1970 Brennan ..... 473/396
4,516,780 A * 5/1985 Tabet ..... 473/398
4,660,837 A * 4/1987 Bressie ..... 473/386
5,671,576 A * 9/1997 Kluser ..... 52/708
5,672,122 A 9/1997 Strong
5,720,677 A 2/1998 Rudduck
D413,640 S 9/1999 Fearer, III
6,083,121 A * 7/2000 Hovey ..... 473/396
6,086,486 A 7/2000 Murphy et al.
6,110,060 A 8/2000 Spoto
6,186,907 B1 2/2001 Woodward
6,328,663 B1 12/2001 Lipstock

* cited by examiner

*Primary Examiner*—Steven Wong
(74) *Attorney, Agent, or Firm*—Dale J. Ream

(57) ABSTRACT

A height adjustable apparatus for supporting a golf tee includes an outer sleeve configured for ground penetration defining an open top into which an inner sleeve is slidably received. The inner sleeve defines an open top for receiving a golf tee therein. The inner and outer sleeves include complementary fasteners such that the inner sleeve may be maintained at a selectable longitudinal configuration relative to the outer sleeve and slidable moved between retracted and extended configurations, whereby to adjust the height of the golf tee. A spring is positioned in the outer sleeve for urging the inner sleeve in an upward direction although the fasteners resist such movement. A cam assembly releases the inner sleeve to be reset to the extended configuration once it has been fully retracted.

18 Claims, 7 Drawing Sheets

HEIGHT ADJUSTABLE GOLF TEE SUPPORT APPARATUS

BACKGROUND OF THE INVENTION

This invention relates generally to golf accessories and, more particularly, to a height adjustable apparatus for supporting a conventional golf tee at a selectable height.

Golfers desire to place their golf ball at a selected height before striking it. It is well known that the optimal height of the ball depends on the size of golf club being utilized at the time. For example, the golfer may desire a higher ball placement for use with a driver than with a five-iron.

Various devices are known in the prior art for supporting a golf ball at a selected height. Although assumably effective for their intended purposes, many existing devices are modified golf tees and thus are expensive to replace each time they are broken during game play. Further, other existing devices do not provide adequate or user-friendly adjustability.

Therefore, it would be desirable to have a height adjustable golf tee supporting apparatus that may be used with conventional golf tees, that is quick and easy to adjust and reset, and that will not be easily broken if impacted by a golf club.

SUMMARY OF THE INVENTION

A height adjustable apparatus for supporting a golf tee according to this invention includes an outer and an inner sleeve. The outer sleeve includes a pointed bottom for ground penetration and defines an open top. The inner sleeve also includes a closed bottom and defines an open top, but includes smaller dimensions so as to be slidably received in the outer sleeve through the outer sleeve open top. A conventional golf tee may be inserted into the inner sleeve through the inner sleeve open top.

The inner sleeve is slidably movable within the outer sleeve and is movable between a retracted configuration therein and an extended configuration extending from the outer sleeve open top. The outer and inner sleeves include complementary fastener structures that engage one another and enable the inner sleeve to be maintained at a selected longitudinal configuration within the outer sleeve. Specifically, an inner surface of the outer sleeve includes a plurality of notches arranged in a longitudinal band and the inner sleeve includes a spring tab with a flange that selectively engages selected notches. The notches and flange are configured to resist an upward movement of the tab but to allow a stepwise downward movement. The apparatus further include a spring and cam assembly that enables the inner sleeve to be quickly reset from a fully retracted configuration to an extended configuration.

Therefore, a general object of this invention is to provide a golf tee support apparatus that is height adjustable.

Another object of this invention is to provide a golf tee support apparatus, as aforesaid, that may be adjusted to a plurality of heights between fully retracted and fully extended configurations.

Still another object of this invention is to provide a golf tee support apparatus, as aforesaid, having a two-part housing that may be longitudinally adjusted to support a conventional golf tee at a selected height.

Yet another object of this invention is to provide a golf tee support apparatus, as aforesaid, including a spring and cam assembly for quickly resetting the sleeves to a fully extended configuration.

A further object of this invention is to provide a golf tee support apparatus, as aforesaid, which includes a flexible inner sleeve that is flexible and resilient so as to resist damage or breakage even if struck by a golf club.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A height adjustable apparatus for supporting a conventional golf tee at a selectable height will now be described in detail with reference to FIGS. 1*a* through 7*b* of the accompanying drawings.

Figure 1A:
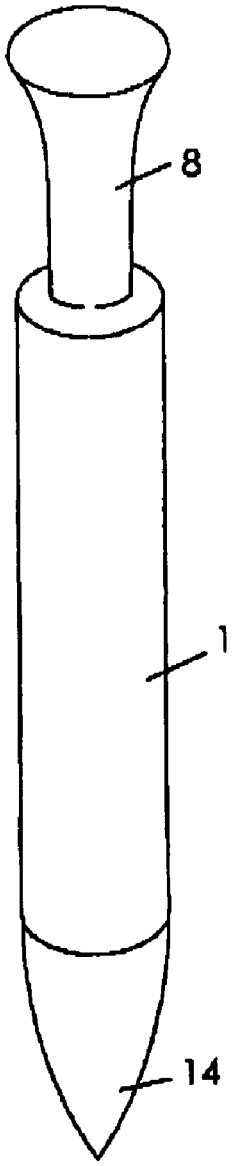
FIG. 1*a* is a perspective view of an adjustable golf tee support apparatus according to the preferred embodiment in a retracted configuration.
Figure 1B:
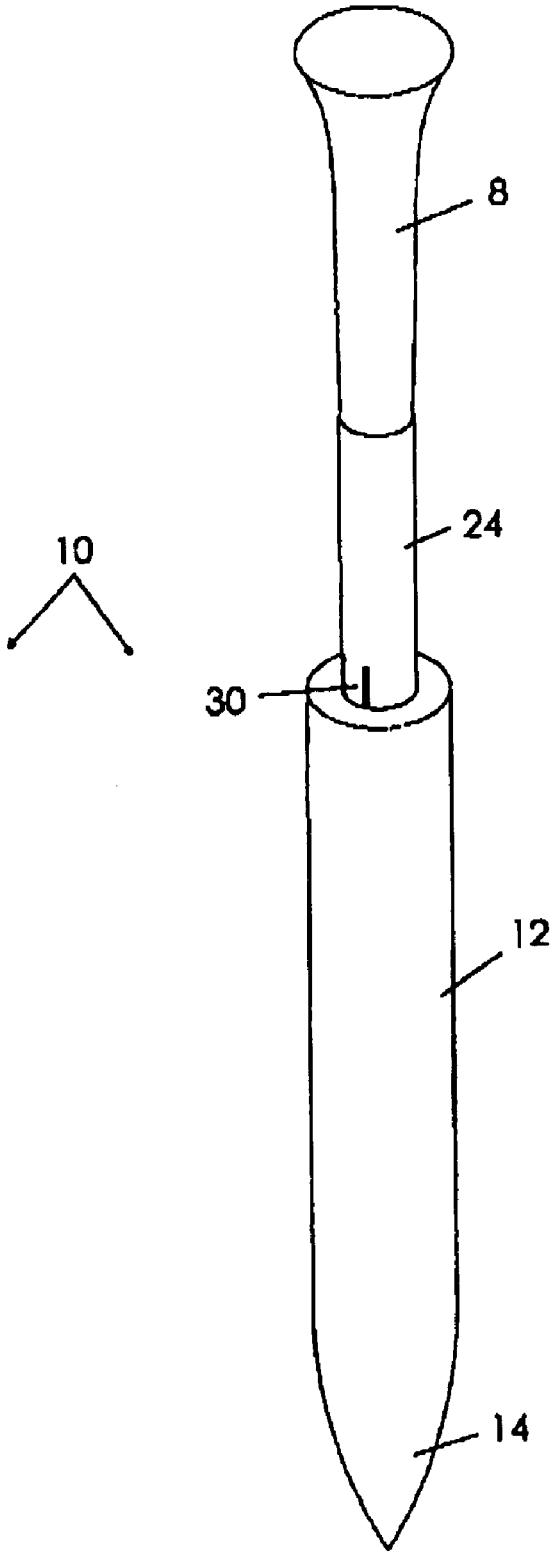
FIG. 1*b* is a perspective view of the support apparatus as in FIG. 1*a* in an extended configuration.
Figure 2:
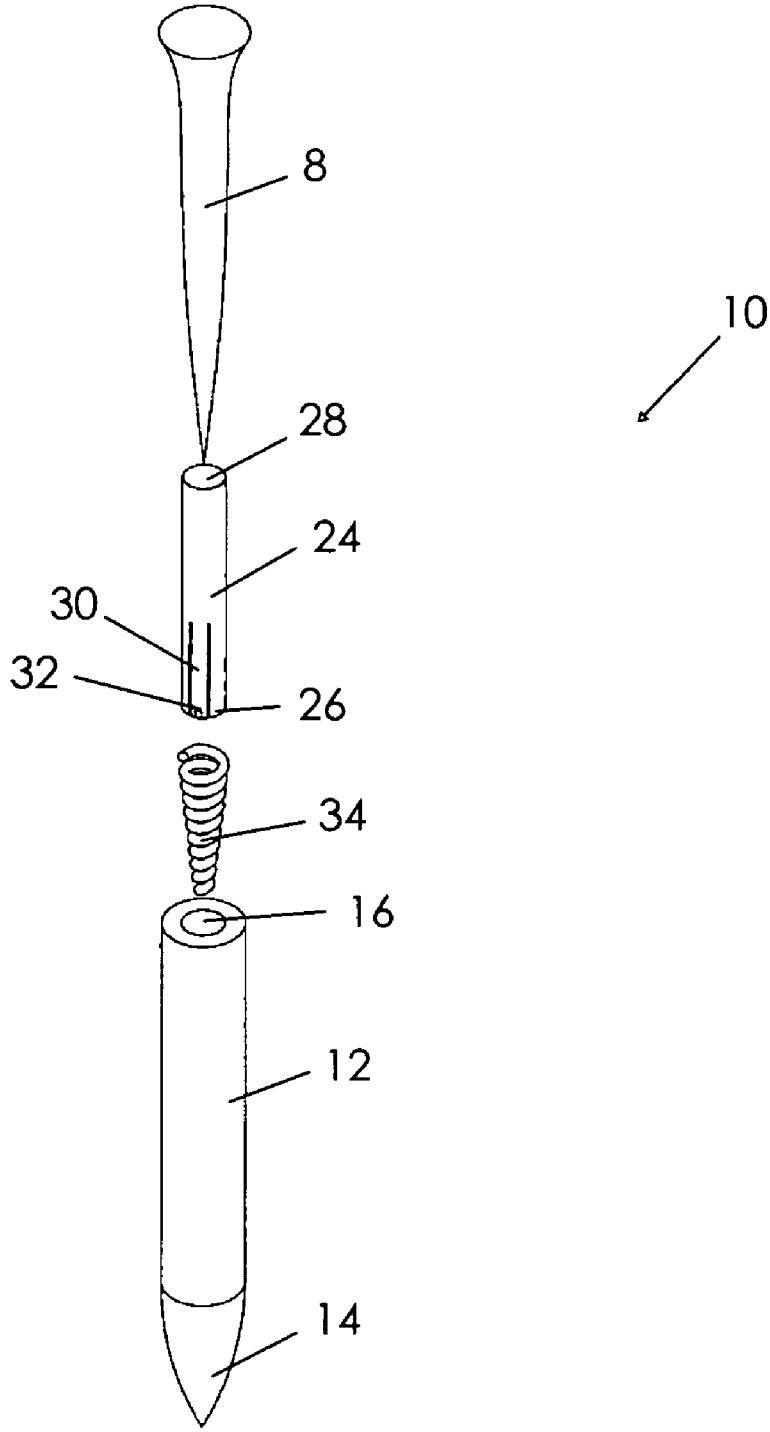
FIG. 2 is an exploded view of the support apparatus as in FIG. 1*a;*

An adjustable height golf tee support apparatus 10 according to a preferred embodiment of the present invention includes a two-piece housing that may be adjusted to a selected height (FIGS. 1*a* and 1*b*). The apparatus 10 includes a generally tubular outer sleeve 12 having a closed bottom 14 and defining an open top 16 (FIG. 2). The outer sleeve 12 is tubular and, therefore, generally hollow. The closed bottom 14 includes a pointed or arrow-shaped configuration for easily penetrating a ground surface.

The apparatus 10 includes an inner sleeve 24 having a closed bottom 26 and defining an open top 28. The inner sleeve 24 also includes a generally tubular configuration and, therefore, defines a hollow interior space suitable for supporting a conventional golf tee therein. The inner sleeve 24 includes an outer diameter slightly smaller than a diameter of the outer sleeve 12 such that the inner sleeve 24 is slidably received in the outer sleeve 12 for relative longitudinal movement.

Figure 3A:
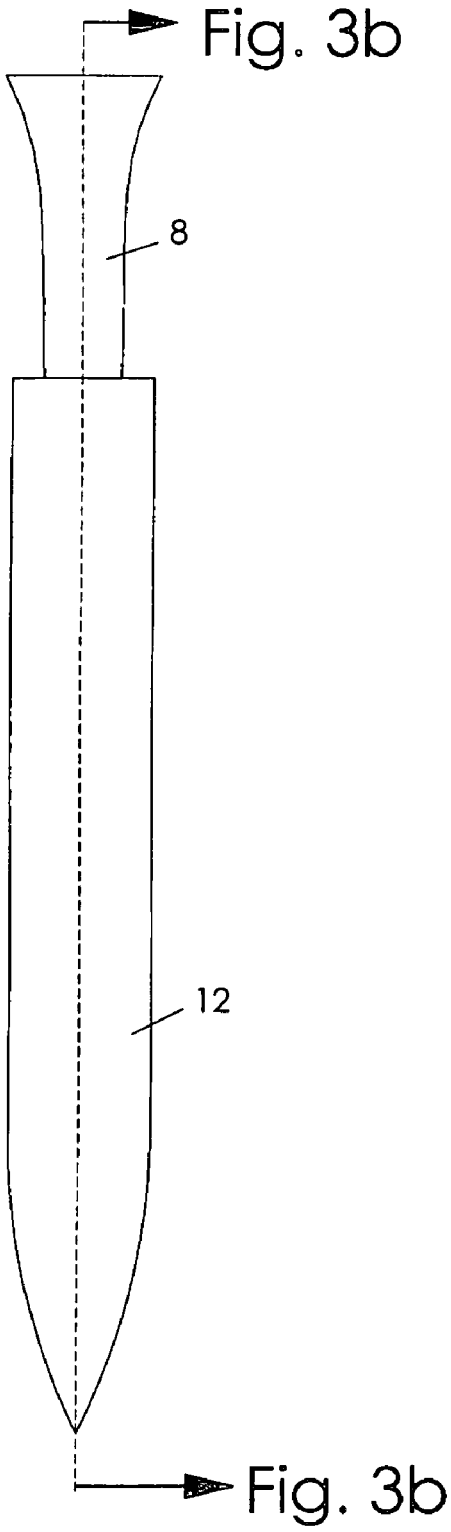
FIG. 3*a* is a side view of the support apparatus as in FIG. 1*a;*
Figure 3B:
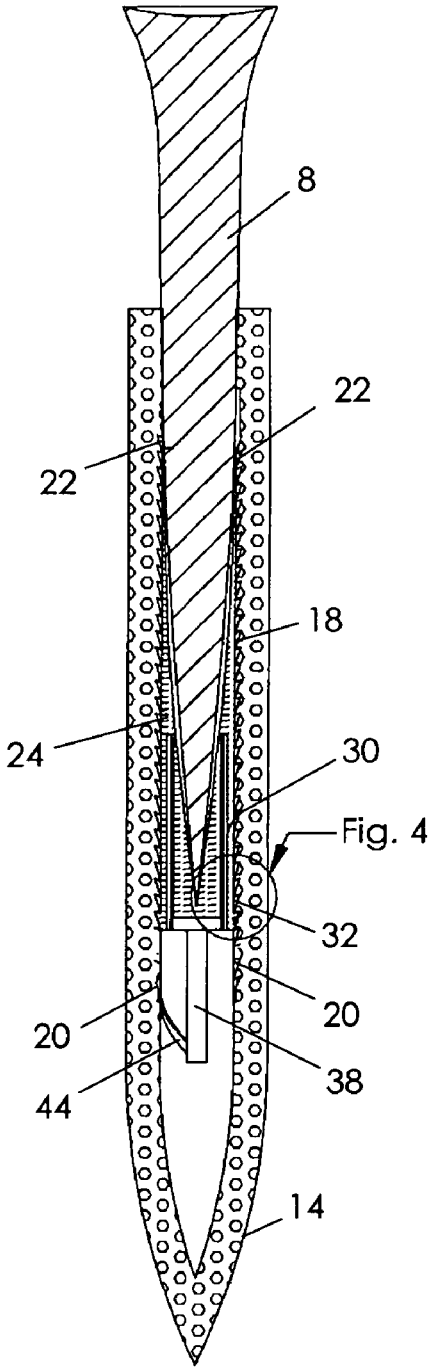
FIG. 3*b* is a sectional view of the support apparatus taken along line 3*b*–3*b* of FIG. 3*a;*
Figure 4:
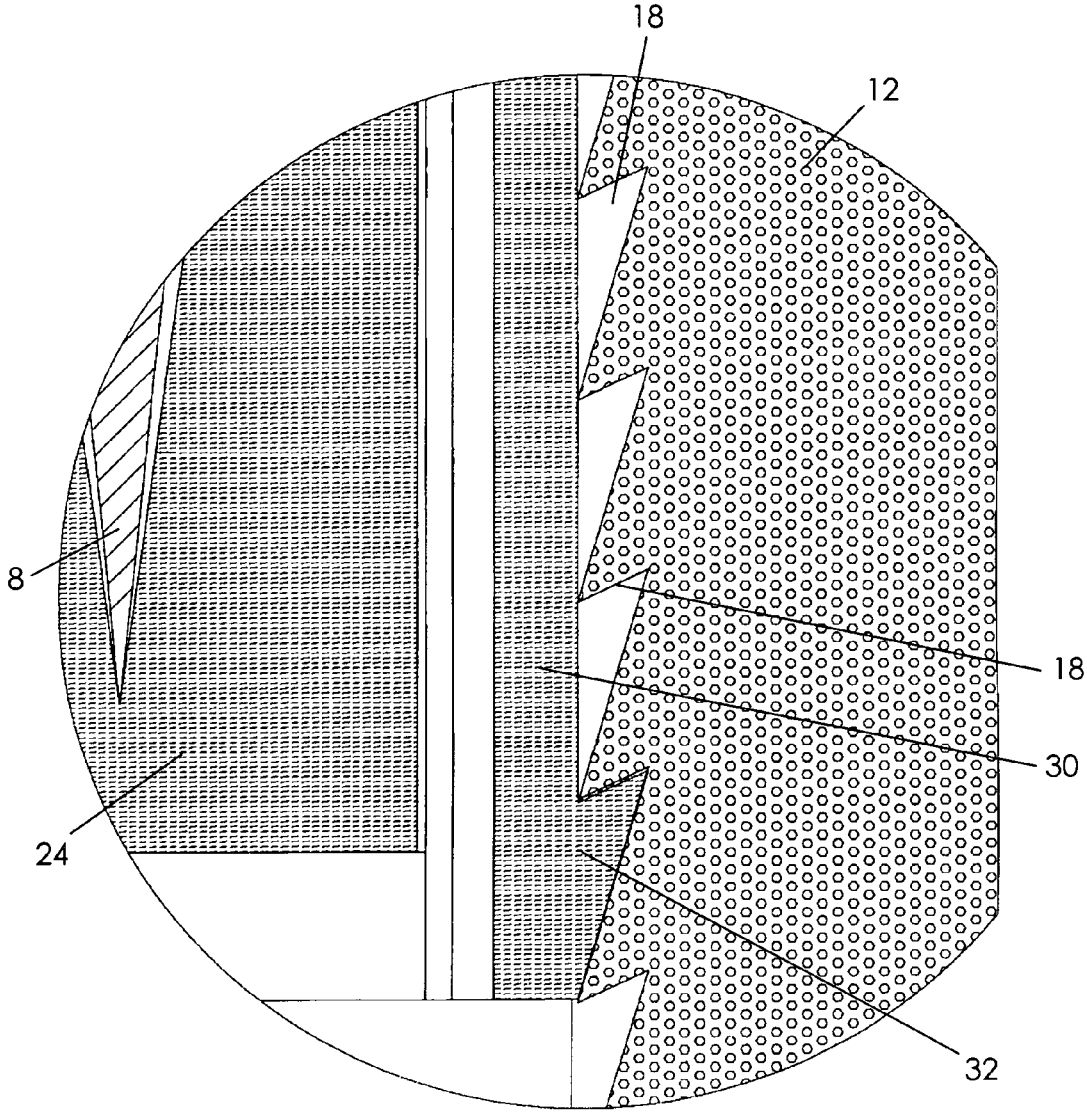
FIG. 4 is an enlarged detail view of a portion indicated in FIG. 3*b;*

As shown in FIGS. 3*b* and 4, the inner 24 and outer 12 sleeves include a pair of complementary fastener structures that enable the inner sleeve 24 to be maintained at a selectable longitudinal configuration relative to the outer sleeve 12. The inner sleeve 24 is movable between an extended configuration in which the inner sleeve open top 28 is outwardly displaced from the outer sleeve open top (FIG. 1*b*) and a retracted configuration in which the inner sleeve is completely retracted within the outer sleeve 12 (FIG. 1*a*). More particularly, an inner surface of the outer sleeve 12 defines a plurality of notches 18 arranged in a longitudinal band extending substantially between the outer sleeve bottom 14 and top 16. It is understood that more than one band of notches would also be suitable.

The inner sleeve includes a tab 30 integrally connected thereto proximate its bottom 26 having a pliable construction such as spring steel, rubber, or an elastomer material. The tab 30 includes an outwardly extending flange 32 having a configuration that is complementary to a configuration of each notch 18 for nesting therein (FIG. 4). The flexibility of the tab 30 and the configurations of the notches 18 and flange 32 enable the inner sleeve to be selectively stepwise retracted into the outer sleeve 12 upon a moderate downward pressure upon the inner sleeve 24. Stated another way, the flange 32 is released from a notch 18 in which it is seated and the tab 30 is pressed inwardly as the flange 32 slides over the next notch structure and seats in the next lower notch recess. It should be appreciated that the plurality of notches 18 and tab flange 32 are configured to allow stepwise downward movement but to resist upward movement.

The apparatus 10 further includes a compression spring 34 positioned in the outer sleeve 12 adjacent the bottom 14 thereof and situated to bias the inner sleeve 24 in an upward direction. Therefore, the inner sleeve 24 is naturally biased by the spring 34 toward the extended configuration.

Figure 5:
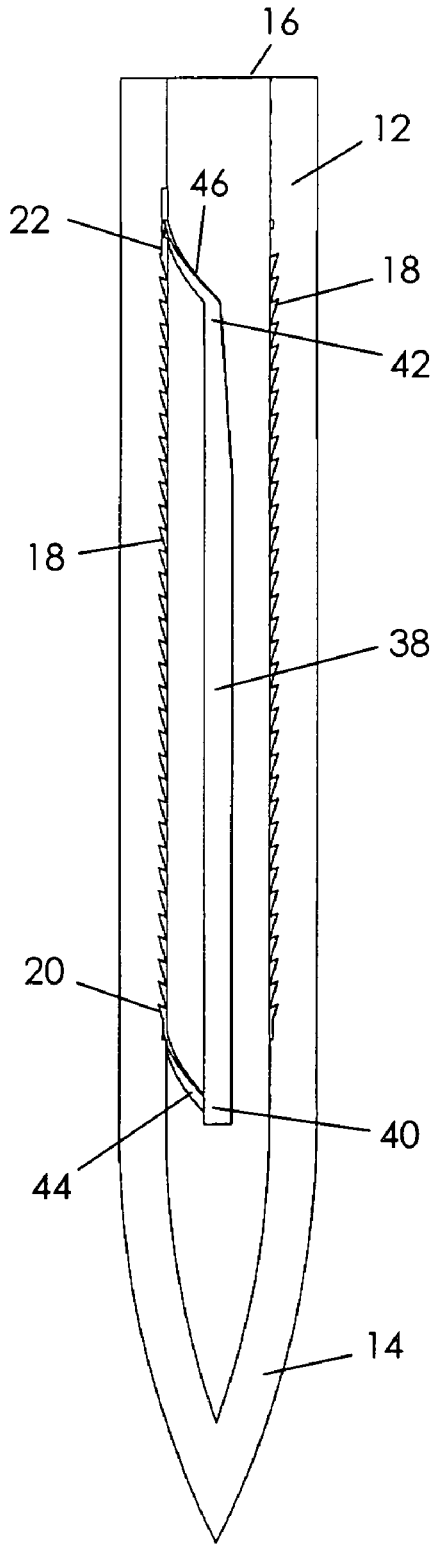
FIG. 5 is a sectional view as in FIG. 3*a* with the inner sleeve and golf tee removed.

As the upward urging of the inner sleeve 24 by the spring 34 is resisted by the complementary configurations of the notches 18 and tab flange 32, a cam assembly 36 is provided in order to return the inner sleeve 24 from a fully retracted configuration to the extended configuration. As best shown in FIG. 5, the cam assembly 36 includes a return slot 38 that extends longitudinally along the inner surface of the outer sleeve 12 substantially between the outer sleeve bottom 14 and top 16. The cam assembly 36 also includes a release groove 44 defined by the outer sleeve inner surface that connects the lowermost notch 20 with a lower end 40 of the return slot. The cam assembly 36 further includes a reset groove 46 connecting an upper end 48 of the return slot 38 with the uppermost notch 22.

It should be observed that the release groove 44 includes a downward angle such that a further downward pressure upon the inner sleeve 24 will communicate the tab flange 32 therealong to the return slot 38. It should be further observed that the reset groove 46 includes a configuration receptive to receiving the tab flange 32 upward to the uppermost notch 22. As the tab flange 32 is moved along the release groove 44, the inner sleeve 24 is rotated about 90° in a first direction, while the inner sleeve 24 is rotated about 90° in an opposite direction when the tab flange 32 travels along the reset groove 46.

Figure 7A:
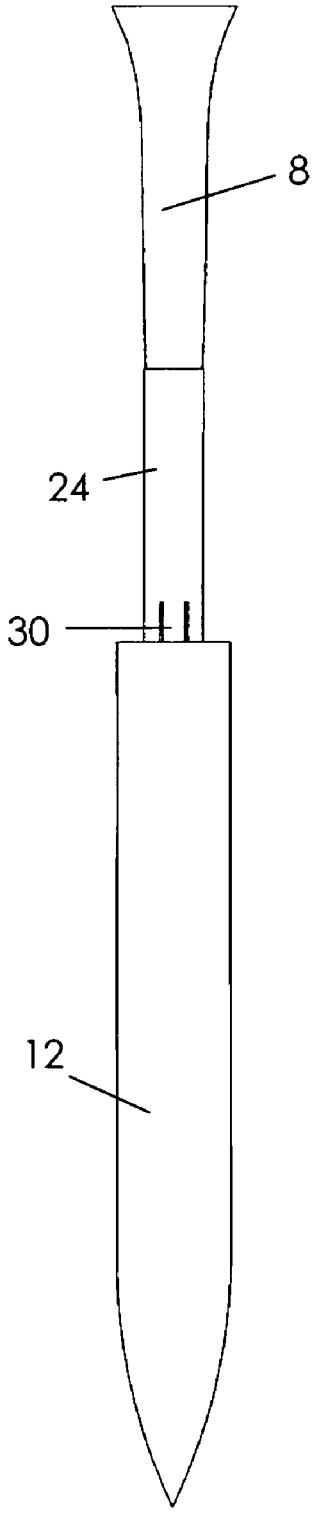
FIG. 7*a* is a side view of the support apparatus as in FIG. 1*a* with the inner sleeve in an upright configuration.
Figure 7B:
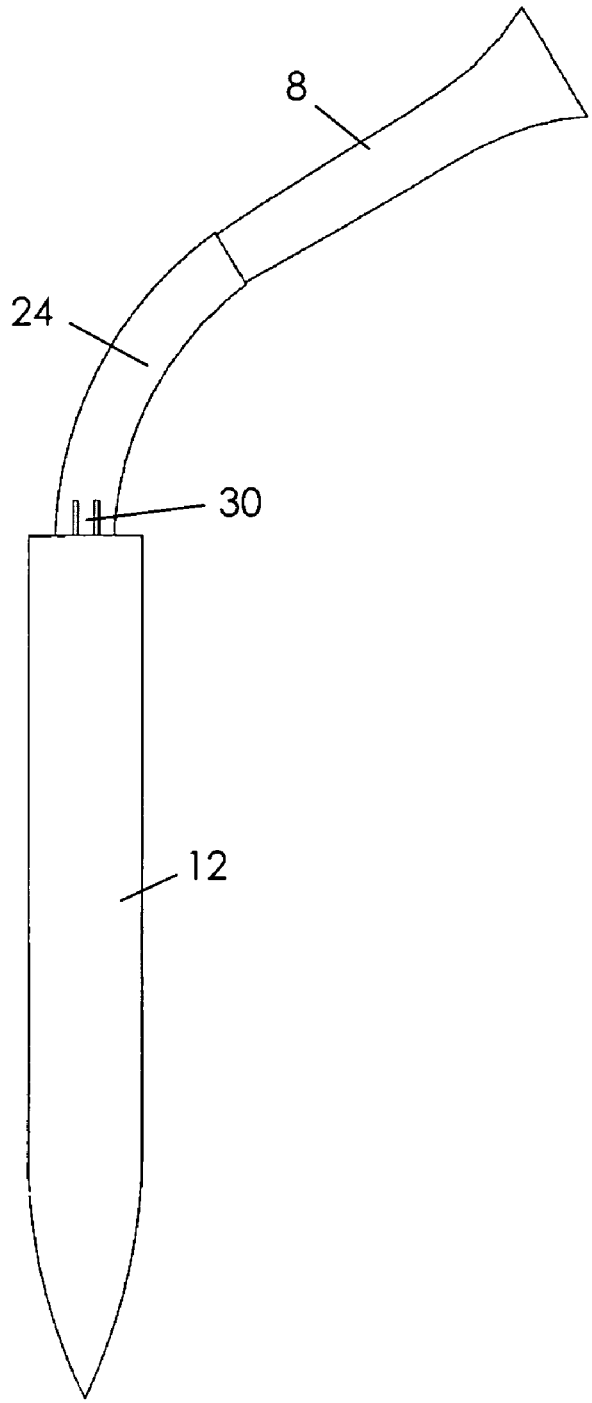
FIG. 7*b* is a side view of the support apparatus as in FIG. 7*a* with the resilient inner sleeve in a flexed configuration.

Further, the entire inner sleeve 24 is constructed of a flexible or pliable material such as rubber or a resilient elastomer. Therefore, the inner sleeve 24 is able to bend without breaking if impacted by a golf club head when positioned in the extended configuration (FIGS. 7*a* and 7*b*). Preferably, the material is resilient so as to return to its original shape. The pliability of the inner sleeve 24 is advantageous not only to reduce the risk of apparatus breakage, but also because the apparatus 10 and tee 8 does not provide resistance to the transfer of energy from the golf club head to the ball. Potential damage to the club head is also greatly reduced.

In use, the inner sleeve 24 may be positioned at a fully extended configuration (FIG. 1*b*). A conventional golf tee 8 may be inserted through the inner sleeve open top 28 in a stable, friction-fit engagement. Gentle downward pressure on the tee 8 causes the stepwise downward movement of the inner sleeve 24 within the outer sleeve 12 so as to position the tee 8 at a selected height. The pointed end 14 of the outer sleeve 12 may be inserted into a ground surface. If the inner sleeve 24 is inadvertently positioned incorrectly, it may be quickly reset by pushing it to a fully retracted configuration and allowing the spring 34 and cam assembly 36 to return it to the fully extended configuration.

Figure 6:
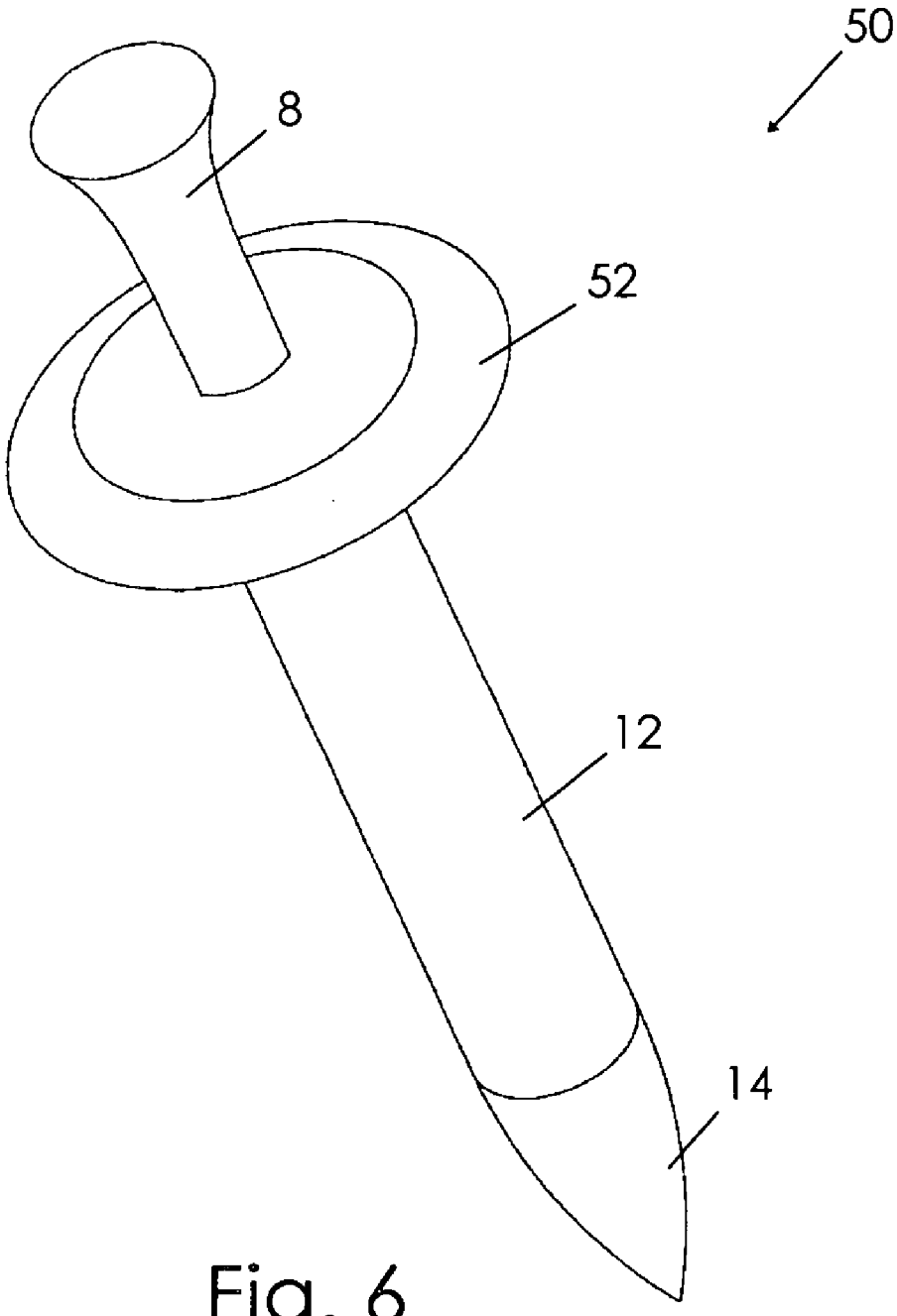
FIG. 6 is a perspective view of an adjustable golf tee support apparatus according to another embodiment of the invention.

An adjustable height golf tee support apparatus 50 according to another embodiment of the present invention is shown in FIG. 6 and includes a construction substantially similar to the construction described previously except as specifically noted below. The apparatus 50 according to this embodiment includes a generally disc-shaped collar 52 mounted atop the outer sleeve 12. The collar 52 defines a central aperture having a diameter at least as large as a diameter of the open top 28 of the inner sleeve 24 such that the inner sleeve 24 is free to move therethrough as it is adjusted between extended and retracted configurations. The use of a fixed collar 52 provides a relative marker for the user. In other words, the outer sleeve 12 may always be inserted into the ground up to the marker, and then the user may develop a set of predetermined "clicks" of downward adjustment of the inner sleeve 24 depending on which club the user intends to use.

It is understood that while certain forms of this invention have been illustrated and described, it is not limited thereto except insofar as such limitations are included in the following claims and allowable functional equivalents thereof.

The invention claimed is:

1. An adjustable height golf tee support apparatus, comprising:

a tubular outer sleeve having an outer sleeve closed bottom and defining an outer sleeve open top;

a tubular inner sleeve slidably received in said outer sleeve through said outer sleeve open top, said inner sleeve having an inner sleeve closed bottom and defining an inner sleeve open top adapted to receive a golf tee therein;

a first fastener structure along an extent of said outer sleeve;

a second complementary fastener structure along an extent of said inner sleeve for engagement with said first fastener structure, whereby said inner sleeve is received in said outer sleeve at a selectable longitudinal configuration;

wherein said first fastener structure includes a plurality of notches defined along an inner surface of said outer sleeve and arranged in a longitudinal band between said outer sleeve bottom and said outer sleeve top;

wherein said second fastener structure includes a spring tab connected to said inner sleeve and having a flange extending outwardly from said tab for engagement with a selectable one of said plurality of notches;

a return slot defined in an inner surface of said outer sleeve and extending longitudinally substantially between said outer sleeve bottom and said outer sleeve top;

a release groove defined in said inner surface of said outer sleeve for connecting a lowermost notch of said first fastener structure with a lower end of said return slot, whereby said flange is communicated to said return slot when moved beyond said lowermost notch;

a reset groove defined in said inner surface of said outer sleeve for connecting an upper end of said return slot with an uppermost notch of said first fastener structure, whereby said flange is communicated into engagement with said uppermost notch when said flange is at said upper end of said return slot.

2. The golf tee support apparatus as in claim 1 wherein said first and second fastener structures are configured to resist an upward movement of said inner sleeve relative to said outer sleeve.

3. The golf tee support apparatus as in claim 1 further comprising a spring positioned in said outer sleeve for urging said inner sleeve toward said outer sleeve open top, whereby said inner sleeve is moved upwardly when said flange is positioned in said return slot.

4. The golf tee support apparatus as in claim 1 wherein said outer sleeve bottom includes a pointed tip for selectively penetrating a ground surface.

5. The golf tee support apparatus as in claim 1 wherein said inner sleeve includes a flexible and resilient construction so as to flexibly receive and withstand an impact by a golf club.

6. The golf tee support apparatus as in claim 5 wherein said inner sleeve is constructed of a rubber or elastomeric material.

7. The golf tee support apparatus as in claim 1 further comprising a disc-shaped collar mounted to said outer sleeve at said open top, said collar defining a central aperture having a diameter at least as large as a diameter of said inner sleeve such that said inner sleeve is movable therethrough.

8. A height adjustable apparatus for supporting a golf tee, comprising:

an outer sleeve having an outer sleeve closed bottom and defining an outer sleeve open top;

an inner sleeve slidably received in said outer sleeve through said outer sleeve open top, said inner sleeve having a closed inner sleeve bottom and defining an inner sleeve open top, said inner sleeve being movable between an extended configuration in which said inner sleeve open top is outwardly displaced from said outer sleeve open top and a retracted configuration in which said inner sleeve is completely positioned within said outer sleeve;

means for biasing said inner sleeve toward said extended configuration;

means for maintaining said inner sleeve at a selectable longitudinal configuration relative to said outer sleeve; and a cam assembly situated in said outer casing for selectably releasing said inner sleeve to move from said retracted configuration to said extended configuration.

9. The apparatus as in claim 8 wherein said biasing means is a spring positioned in said outer sleeve between said outer sleeve bottom and said inner sleeve bottom, said spring bearing against said inner sleeve bottom.

10. The apparatus as in claim 8 wherein said maintaining means includes:

a first fastener structure along an extent of said outer sleeve; and a second complementary fastener structure along an extent of said inner sleeve for engagement with said first fastener structure, whereby said inner sleeve is received in said outer sleeve at a selectable longitudinal configuration.

11. The apparatus as in claim 10 wherein:

said first fastener structure includes a plurality of notches defined along an inner surface of said outer sleeve and arranged in a longitudinal band between said outer sleeve bottom and said outer sleeve top; and said second fastener structure includes a resilient tab connected to said inner sleeve and having a flange extending outwardly from said tab for engagement with a selectable one of said plurality of notches.

12. The apparatus as in claim 11 wherein said plurality of notches and said flange are configured to resist relative movement toward said extended configuration.

13. The apparatus as in claim 11 wherein said cam assembly includes:

a return slot defined in an inner surface of said outer sleeve and extending longitudinally substantially between said outer sleeve bottom and said outer sleeve top;

a release groove defined in said inner surface of said outer sleeve for connecting a lowermost notch of said first fastener structure with a lower end of said return slot, whereby said flange is communicated to said return slot when moved beyond said lowermost notch; and a reset groove defined in said inner surface of said outer sleeve for connecting an upper end of said return slot with an uppermost notch of said first fastener structure, whereby said flange is communicated into engagement with said uppermost notch when said flange is at said upper end of said return slot, whereby said flange, when positioned in said return slot, is slidably movable along said return slot when said inner sleeve is urged toward said extended configuration by said biasing means.

14. The apparatus as in claim 13 wherein:

a movement of said flange along said release groove from said lowermost notch to said return slot rotates said inner sleeve about 90° in a first direction;

a movement of said flange along said reset slot from said return slot to said uppermost notch rotates said inner sleeve about 90° in a second direction opposite said first direction.

15. The apparatus as in claim 8 wherein said inner sleeve includes a flexible and resilient construction so as to flexibly withstand an impact by a golf club.

16. The apparatus as in claim 15 wherein said inner sleeve is constructed of a rubber or elastomeric material.

17. The apparatus as in claim 8 further comprising a disc-shaped collar mounted to said outer sleeve at said open top, said collar defining a central aperture having a diameter at least as large as a diameter of said inner sleeve such that said inner sleeve is movable therethrough.

18. A height adjustable apparatus for supporting a golf tee, comprising:

an outer sleeve having an outer sleeve closed bottom and defining an outer sleeve open top;

an inner sleeve slidably received in said outer sleeve through said outer sleeve open top, said inner sleeve having a closed inner sleeve bottom and defining an inner sleeve open top adapted to receive a golf tee therein, said inner sleeve being movable between an extended configuration in which said inner sleeve open top is outwardly displaced from said outer sleeve open top and a retracted configuration in which said inner sleeve is completely positioned within said outer sleeve;

a spring positioned in said outer sleeve for biasing said inner sleeve toward said extended configuration;

a first fastener structure along an extent of said outer sleeve;

a second complementary fastener structure along an extent of said inner sleeve for engagement with said first fastener structure, whereby said inner sleeve is received in said outer sleeve at a selectable longitudinal configuration; and a cam assembly situated in said outer casing for selectably releasing said inner sleeve to move from said retracted configuration to said extended configuration.

* * * * *